US008157437B2

(12) United States Patent
Richmond

(10) Patent No.: US 8,157,437 B2
(45) Date of Patent: Apr. 17, 2012

(54) INSULATED BEVERAGE CONTAINER WITH COUNTING DEVICE

(75) Inventor: Justin Richmond, Portland, OR (US)

(73) Assignee: Justin L Richmond, Portland, OR (US)

( * ) Notice: Subject to any disclaimer, the term of this patent is extended or adjusted under 35 U.S.C. 154(b) by 26 days.

(21) Appl. No.: 12/884,323

(22) Filed: Sep. 17, 2010

(65) Prior Publication Data

US 2012/0067904 A1 Mar. 22, 2012

(51) Int. Cl.
*G04F 8/00* (2006.01)

(52) U.S. Cl. ..... 368/89; 368/108

(58) Field of Classification Search ..... 368/89, 368/107–108

See application file for complete search history.

(56) References Cited

U.S. PATENT DOCUMENTS 4,419,016 A * 12/1983 Zoltan ..... 368/10
4,555,624 A * 11/1985 Steffen ..... 250/223 R
5,044,914 A * 9/1991 Schulling ..... 425/169
5,170,380 A * 12/1992 Howard et al. ..... 368/10
5,299,356 A * 4/1994 Maxwell, III ..... 30/322
5,335,212 A * 8/1994 Bartos ..... 368/107
5,339,548 A * 8/1994 Russell ..... 40/324
5,495,961 A * 3/1996 Maestre ..... 221/3
5,724,021 A * 3/1998 Perrone ..... 340/309.7
5,746,348 A * 5/1998 Bloom ..... 222/39
5,842,353 A * 12/1998 Kuo-Liang ..... 62/190
5,969,592 A * 10/1999 Reed ..... 340/384.1
6,213,616 B1 * 4/2001 Chien ..... 362/84
6,229,764 B1 * 5/2001 Tongue ..... 368/110
6,317,390 B1 * 11/2001 Cardoza ..... 368/10
6,324,963 B1 * 12/2001 Cirasole ..... 99/285
6,371,420 B1 * 4/2002 Strunk ..... 248/111
6,378,906 B1 * 4/2002 Pennaz ..... 283/81
6,529,446 B1 * 3/2003 de la Huerga ..... 368/10
7,022,946 B2 * 4/2006 Sanoner et al. ..... 219/387
7,081,807 B2 * 7/2006 Lai ..... 340/309.7
7,382,692 B1 * 6/2008 Hildebrandt ..... 368/10
7,417,417 B2 * 8/2008 Williams et al. ..... 324/71.1
7,515,507 B2 * 4/2009 Nanda ..... 368/10
7,532,544 B2 * 5/2009 Morse ..... 368/19
7,621,273 B2 * 11/2009 Morton et al. ..... 128/205.23
7,710,830 B2 * 5/2010 Mansmann et al. ..... 368/9
7,998,407 B2 * 8/2011 Wohland ..... 422/404
2003/0210141 A1 * 11/2003 Iacovino ..... 340/539.1
2004/0140304 A1 * 7/2004 Leyendecker ..... 219/386
2004/0264300 A1 * 12/2004 Gratkowski ..... 368/3
2006/0219858 A1 * 10/2006 Iacovino ..... 248/311.2
2006/0293151 A1 * 12/2006 Rast ..... 482/8
2007/0068944 A1 * 3/2007 McKinney et al. ..... 220/256.1
2007/0091726 A1 * 4/2007 Stauffer et al. ..... 368/10
2009/0185450 A1 * 7/2009 Nanda ..... 368/10

* cited by examiner

*Primary Examiner* — Sean Kayes

(57) ABSTRACT

A thermo insulated beverage container having a sensor and a counting device. The sensor senses the number of beverages that have been placed into the container and the counting device records the sensor signal as a count repetition and displays the count on a displayer which is a count of the total number of beverages that have been placed into the container from the beginning and a count of the total number of beverages that have been placed into the container from the time that the counter was reset.

20 Claims, 1 Drawing Sheet

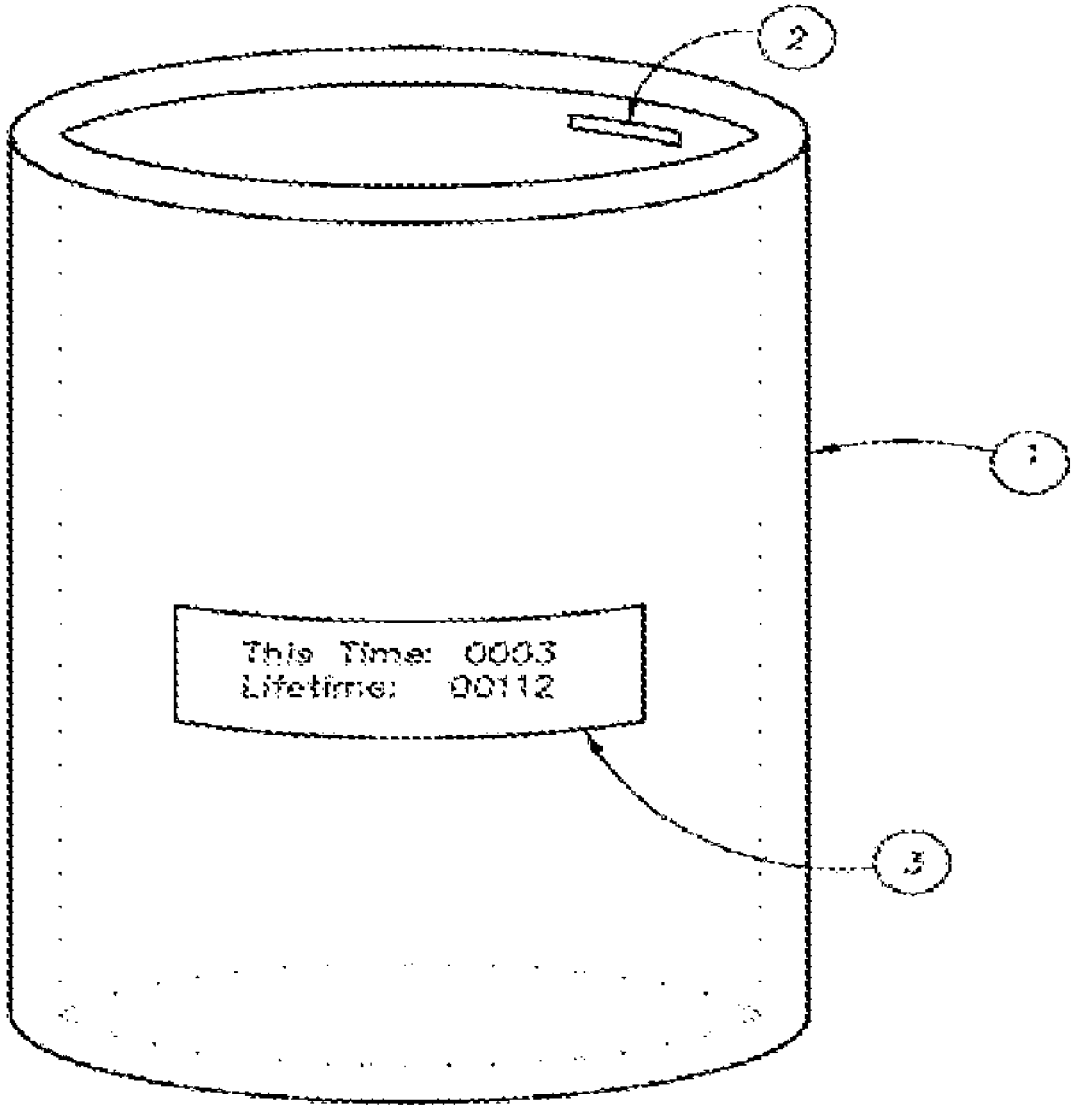
2
1
This Time: 0003
Lifetime: 00112
3

INSULATED BEVERAGE CONTAINER WITH COUNTING DEVICE

BACKGROUND OF THE INVENTION

1. Field of the Invention

The present application relates to a container, and more particularly to an insulated container which can sense and count the number of times beverages and other content that have been placed into the container.

2. Description of Related Art

Note that the points discussed below may reflect the hindsight gained from the disclosed inventions, and are not necessarily admitted to be prior art.

Insulated containers have been widely used in keeping food or beverages in certain temperature, either ice cold or heated, for picnics or other outdoor activities. The container is usually a rectangular box having a hinged lid that is made of double layered plastic in the body and lid, with thermo foam insulation preventing heat exchange.

The rectangular box can be of different sizes, depending on its use for the number of people. For large family or a party of a crowd of more than ten, the container can have a dimension wider, deeper and longer than 2 feet, which could contain more than 100 cans of beer or other drinks.

Conventionally, people make a mental note of how many individual drinks such as, for example, cans of beers, soda, milk, etc. having been placed into the container which may be a cooler, and check on the cooler for how many times it has been refilled with another can of beer, soda, etc. In the slurry of activities, people may become so tired or occupied, they may forget about the food that is left in the container. And they often lose track on how many individual drinks such as cans of beers have been consumed. For caterers of a big festival, it may become a mission impossible for them to keep track of all the beverages that have been consumed.

Therefore, there is a need for a container/cooler that helps keep track of the number of beverages being consumed or food that might be left over in the container, either to ease the task of management of a festival, or to serve as a reminder for people to remain sober or in control.

SUMMARY OF THE INVENTION

The present application discloses a container for holding a can of beer or soda of a container of milk, etc. where the container may or may not also be a cooler and includes an embedded sensor and at least two counters where one counter counts the total number of times a new can has been placed into the container from the time that the container was first used up to the present, and the second counter that can be reset at any time to start a new count of the number of times a can has been placed in the container.

In one embodiment, a sensor senses an addition or removal of an item from the container, a signal is generated and sent to a digital counter for recording. A microprocessor in the counter contains a software program which records and counts the signal status and changes the counter to the next up count.

In one embodiment, a second counter is included which has a "reset" button to start a new round of counting. The counter displayer may also displays the length of time along with the total number of counts of beverages that has been placed into the container.

With a sensor and at least two separate counter displays installed in a liquid container which may or may not be a cooler, people can keep track of the number individual drinks such as beers that have been placed in the container from the very beginning of it life and the number of drinks that are being consumed at a festival or party; and where party caterers can ease the task of managing a party by simply checking the counters of on the containers.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 1 schematically shows an example cylindrical container which may be a cooler that has a sensor and at least two counter displays where one of the displays shows the total number of individual servings of beverages which have been dispensed from the container, and a second display which can be reset to show the number of individual servings of beverages which have been dispensed from the time the display was reset.

DESCRIPTION OF THE PREFERRED EMBODIMENT

The numerous innovative teachings of the present application will be described with particular reference to presently preferred embodiments (by way of example, and not of limitation). The present application describes several inventions, and none of the statements below should be taken as limiting the claims generally.

For simplicity and clarity of illustration, the drawing FIGURES illustrate the general manner of construction, and description and details of well-known features and techniques may be omitted to avoid unnecessarily obscuring the invention. Additionally, elements in the drawing FIGURES are not necessarily drawn to scale, some areas or elements may be expanded to help improve understanding of embodiments of the invention.

The terms "first," "second," "third," "fourth," and the like in the description and the claims, if any, may be used for distinguishing between similar elements and not necessarily for describing a particular sequential or chronological order. It is to be understood that the terms so used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

It is contemplated for the insulated container to be any shape and made of any material, any configuration, and any size.

In reference to FIG. 1, in the thermo wall of the body of a cylindrical container 1 are at least one sensor 2 and at least two counter displays 3 embedded inside where one of the counter displays can be reset. Sensor 2 may be located either at the entry opening of the container 1, or at the bottom of the container 1, depending on the sensing mechanism adopted by the manufacturer. The two counters 3 are embedded in the wall of the container and the counter displays are exposed to the open air on the outside surface of the container so that they can be read from a distance.

In a preferred embodiment, a photo sensor and counter circuit, such as an example described in U.S. Pat. No. 4,555,624, the entirety of which is hereby incorporated by reference, may be installed. The photo sensor may have two portions, an emitter and a receiver. The emitting portion emits electromagnetic radiation, for example, a laser light, and the receiving portion receives a reflection of the radiation from a passing object and produces an output signal in proportion to the amount of received radiation. When an object, such as a can of a beverage passes the photo sensor the reflected electromagnetic radiation is much higher than the background noise producing a large spike in the signal. The receiver can be equipped with a plurality of photo-sensitive receiving elements spaced laterally along the wall. The receiver signal can be either directly connected with a counter circuit board and microprocessor that contains software programs which record and count the state of signals each time a change is detected.

Or the receiver can be electronically connected with switches, during operation the switches generate signals indicative of the placement of objects into storage or removal of such objects from storage. The switch elements change states (off-to-on) when an electromagnetic signal is received. The signals indicating changes in the status of the switches are detected by a signal processing circuit which converts the signals to an appropriate form to be received and counted by a microprocessor of the counter. The counter then stores a count which is displayed on a displayer along with the time passed.

In an example, the counter assembly can be configured to have a set time period which counts down to zero. The counter assembly fits within the device body and includes a foam ring that forms the top of the device to expose a plurality of counter buttons. One of the buttons may be an "On/Reset" button, another button for an "Increase time" function. Power to the counting device is turned on by pressing the On/Reset button, the display, upon power on, defaults to display count repetition and minutes passed.

The sensor and counting system may be powered by a battery or electricity from an electrical cord. Other sensors, such as a thermo sensor or pressure sensor may also be installed, and sensed results can be displayed on the displayer.

As will be recognized by those skilled in the art, the innovative concepts described in the present application can be modified and varied over a large range of applications, and accordingly the scope of patented subject matter is not limited by any of the specific exemplary teachings given. It is intended to embrace all such alternatives, modifications and variations that fall within the spirit and broad scope of the appended claims.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A beverage container, comprising:

a thermo insulated housing having a bottom side, and a side wall, wherein the side wall having a top edge and a bottom edge, the bottom edge intersecting with the bottom side forming the housing, the top edge forming an entry aperture;

a sensor, embedded inside the side wall, facing inside the entry aperture, when sensing an object that passes through the entry aperture, sending a signal; and a counter and control assembly embedded inside the housing and electronically connected with the sensor so as to receive the signal, the counter and control assembly maintaining at least one incremental count responsive to the signals, a displayer facing outside the side wall, and displays the incremental and either one of a countdown time or an elapsed time indicating a time corresponding to the incremental count; and wherein the beverage container is sized and shaped to be able to retain and substantially enclose the sides and bottom of a separate beverage container.

2. The beverage container of claim 1, wherein the sensor is a photo sensor.

3. The beverage container of claim 1, wherein the displayer additionally displays at least one of time elapsed, the total number of objects that have passed through the entry aperture from a beginning, or the total number of objects that have passed through the entry aperture from a time when the counter was reset.

4. The beverage container of claim 1, wherein the counter and control assembly includes an ON/RESET button that clears the incremental count.

5. The beverage container of claim 1, wherein the sensor includes a switch mechanism.

6. The beverage container of claim 1, is additionally sized and configured to receive and recognize a beverage can so that the incremental count corresponds to a number of times a beverage can was inserted into the beverage container.

7. The beverage container of claim 1, further comprising a reset button which when pushed resets the incremental count.

8. The beverage container of claim 1, wherein the displayer further displays a total incremental count corresponding to a time frame larger than the incremental or countdown time.

9. The beverage container of claim 8, further comprising a reset button which when pushed resets the incremental count.

10. The beverage container of claim 9, wherein the reset button does not alter the total incremental count.

11. The beverage container of claim 1, wherein the either one of a countdown time or an elapsed time is a countdown time.

12. The beverage container of claim 11, further comprising an increase time button which when pressed increases the time of the countdown time.

13. The beverage container of claim 11, wherein the displayer further displays a total incremental count corresponding to a time frame larger than the incremental or countdown time.

14. The beverage container of claim 13, further comprising a reset button which when pushed resets the incremental count.

15. The beverage container of claim 1, wherein the either one of a countdown time or an elapsed time is an elapsed time.

16. The beverage container of claim 13, is additionally sized and configured to receive and recognize a beverage can so that the incremental count corresponds to a number of times a beverage can was inserted into the beverage container.

17. A beverage container, comprising:

a thermo insulated housing having a bottom side, and a side wall, wherein the side wall having a top edge and a bottom edge, the bottom edge intersecting with the bottom side forming the housing, the top edge forming an entry aperture;

a sensor, embedded inside the side wall, facing inside the entry aperture, when sensing an object that passes through the entry aperture, sending a signal; and a counter and control assembly embedded inside the housing and electronically connected with the sensor so as to receive the signal, the counter and control assembly maintaining at least one incremental count responsive to a plurality of the signals, a displayer facing outside the side wall, and displays the incremental and either one of a countdown time or an elapsed time indicating a time corresponding to the incremental count; and wherein the beverage container is sized and shaped to be able to retain and substantially enclose the sides and bottom of a separate beverage can.

18. The beverage container of claim 17, wherein the sensor is a photo sensor.

19. The beverage container of claim 17, wherein the displayer further displays a total incremental count corresponding to a time frame larger than the incremental or countdown time.

20. The beverage container of claim 19, further comprising a reset button which reset the incremental count and does not reset the total incremental count.

* * * * *